US006854406B2

(12) United States Patent
Cardoza et al.

(10) Patent No.: US 6,854,406 B2
(45) Date of Patent: Feb. 15, 2005

(54) AUTONOMOUS SURFACE WATERCRAFT

(75) Inventors: Miguel A. Cardoza, Round Rock, TX (US); Sarah Benedict, Austin, TX (US); Anne Mayoral, Austin, TX (US); Matthew Bennett, Austin, TX (US); J. Clark Hughes, Austin, TX (US); Donald Tucker, Austin, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 0 days.

(21) Appl. No.: 10/411,071

(22) Filed: Apr. 10, 2003

(65) Prior Publication Data

US 2004/0015277 A1 Jan. 22, 2004

Related U.S. Application Data

(60) Provisional application No. 60/371,513, filed on Apr. 10, 2002.

(51) Int. Cl.[7] ..... B63H 25/00
(52) U.S. Cl. ..... 114/144 RE
(58) Field of Search ..... 440/6; 114/258, 114/315, 312, 313, 144 RE; 701/21

(56) References Cited

U.S. PATENT DOCUMENTS

| | | | | | |
|---|---|---|---|---|---|
| 5,046,359 | A | * | 9/1991 | Layport | 73/170.33 |
| 5,105,753 | A | * | 4/1992 | Chih et al. | 114/315 |
| 5,253,605 | A | * | 10/1993 | Collins | 114/259 |
| 5,577,942 | A | | 11/1996 | Juselis | |
| 5,596,261 | A | * | 1/1997 | Suyama | 320/152 |
| 5,598,152 | A | | 1/1997 | Scarzello et al. | |
| 6,118,066 | A | * | 9/2000 | Sirmalis et al. | 114/20.1 |
| 6,273,015 | B1 | * | 8/2001 | Motsenbocker et al. | 114/61.12 |
| 6,555,265 | B1 | * | 4/2003 | Fleming et al. | 429/160 |
| 2001/0025594 | A1 | * | 10/2001 | Daniels | 114/315 |

FOREIGN PATENT DOCUMENTS

| | | |
|---|---|---|
| EP | 0 347 288 | 12/1989 |
| EP | 0788969 | 8/1997 |
| FR | 2 737 026 | 1/1997 |
| FR | 2 796 917 | 2/2001 |
| GB | 2 163 114 | 2/1986 |
| GB | 2359049 | 8/2001 |
| JP | 03266794 | 11/1991 |

OTHER PUBLICATIONS

International Search Report for PCT/US03/11091 mailed Nov. 14, 2003.

* cited by examiner

*Primary Examiner*—Ed Swinehart
(74) *Attorney, Agent, or Firm*—Chalker Flores LLP; Edwin S. Flores; Daniel J. Chalker

(57) ABSTRACT

An autonomous surface watercraft is disclosed. The watercraft may include a control module, a communications module, a power management module, a differential thrust propulsion system, and a navigation module. One or more sensors may be provided internal to the watercraft and/or coupled to a sensor module coupling point on the watercraft. An operator may provide the watercraft with mission parameters such as but not limited to station point(s), a sensing location or area, a sensing duration, and/or a sensing time. The watercraft may determine a course heading to reach a station point or sensing area. The control module may control the propulsion system to reach the station point and for station keeping. The watercraft may gather sensor data. The sensor data may be analyzed, filtered, stored in memory and/or transmitted to a control center. The control center may receive real-time data from a plurality of such watercraft.

39 Claims, 10 Drawing Sheets

AUTONOMOUS SURFACE WATERCRAFT

PRIORITY CLAIM

This application claims the benefit of the U.S. Provisional Patent Application Ser. No. 60/371,513 entitled "AUTONOMOUS SURFACE WATERCRAFT," to Cardoza et al. and filed Apr. 10, 2002.

STATEMENT REGARDING FEDERALLY SPONSORED RESEARCH OR DEVELOPMENT

This invention was made with Government support under Contract # N00039-96-D-0051-5-48, Contract # N00039-96-D-0051-5-65, Contract # N00039-96-D-0051-5-96, and Contract # N00039-96-D-0051-5-121 each under the project entitled "Navy Mobile Instrumentation System, PILS II," awarded by the U.S. Navy. The Government has certain rights to this invention.

BACKGROUND OF THE INVENTION

1. Field of the Invention

Embodiments presented herein generally relate to surface watercraft. More specifically, embodiments relate to autonomous surface watercraft and data gathering using said watercraft.

2. Description of the Relevant Art

Some areas of the world's bodies of water remain inhospitable, remote, and/or otherwise unsuitable for direct human research (e.g., gathering sensor readings over large areas). Additionally, using large research vessels to take sensor readings over an area of interest may be time and cost prohibitive. It may, therefore, be advantageous to provide a system and method to remotely gather sensor data from such areas.

SUMMARY OF THE INVENTION

Embodiments disclosed herein generally relate to autonomous watercraft. More specifically, embodiments relate to autonomous watercraft usable as station keeping buoys. For example, certain embodiments relate to autonomous watercraft capable of navigating to a station point, maintaining a position relative to the station point, and gathering sensor data. In certain embodiments, the watercraft may navigate to multiple station points for data gathering and/or gather sensor data over an area of interest.

In an embodiment, an autonomous surface watercraft may include, but is not limited to, a communications module, a navigation module, a power management module, and/or a control module disposed within a hull assembly. In an embodiment, the hull assembly may include a substantially watertight seal. A propulsion system, including one or more thrusters, may be coupled to the hull. The thrusters may be mounted such that differential thrust may be used to both propel and steer the watercraft. The hull may further include one or more sensor module coupling points. In certain embodiments, a sensor module coupling point may allow a sensor module to be coupled to the hull assembly without opening the substantially watertight seal of the hull assembly. In such embodiments, a sensor module attachment point may be configured to mechanically and electrically couple a sensor module to the watercraft. The hull assembly may have a foil shape. A number of laterally mounted pontoons may provide roll stability to the watercraft. The watercraft may also be provided with one or more lifting assemblies to aid in retrieval of the watercraft.

In an embodiment, the watercraft may include at least one rechargeable power supply. For example, at least one rechargeable power supply may include one or more batteries. In certain embodiments, the watercraft may be configured such that at least one rechargeable power supply may be recharged without opening a substantially watertight seal of the hull assembly.

In an embodiment, the watercraft may determine a course heading for navigation to station points and/or for station keeping. For example, the watercraft may receive input corresponding to a location of a station point. The watercraft may determine a course required to reach the station point. Determining a course heading may include determining the speed and direction of a current. Determining the course heading may also include minimizing power expenditures. After reaching a station point, the watercraft may determine a course required for station keeping (e.g., based on wind direction and speed and/or current direction and speed). In certain embodiments, the watercraft may receive input corresponding to an area of interest (e.g., an area over which sensor data should be collected). The watercraft may determine a course to reach the area of interest. Additionally, the watercraft may determine one or more locations for sensor data gathering within the area of interest.

In an embodiment, the watercraft may include a communications module. For example, the communications module may include a radio modem for receiving mission parameters (e.g., sensor data gathering time, location, and duration). Additionally, the communications module may transmit sensor data, system diagnostic data, etc. to a control center. The control center may analyze, filter and/or store the transmitted data. For example, sensor data transmitted by a plurality of watercraft may be presented to a control center operator in real-time. The control center may also remotely provide mission parameters to each watercraft.

It is believed that providing small, autonomous surface watercraft to take sensor readings over large areas may save researchers time and money. An advantage of such watercraft may be that their small size and low cost may allow fleets of the watercraft to be deployed in an area to take sensor readings, thereby significantly reducing time required to gather sensor data.

BRIEF DESCRIPTION OF THE DRAWINGS

Other objects and advantages of the invention will become apparent upon reading the following detailed description and upon reference to the accompanying drawings in which.

Figure 1A:
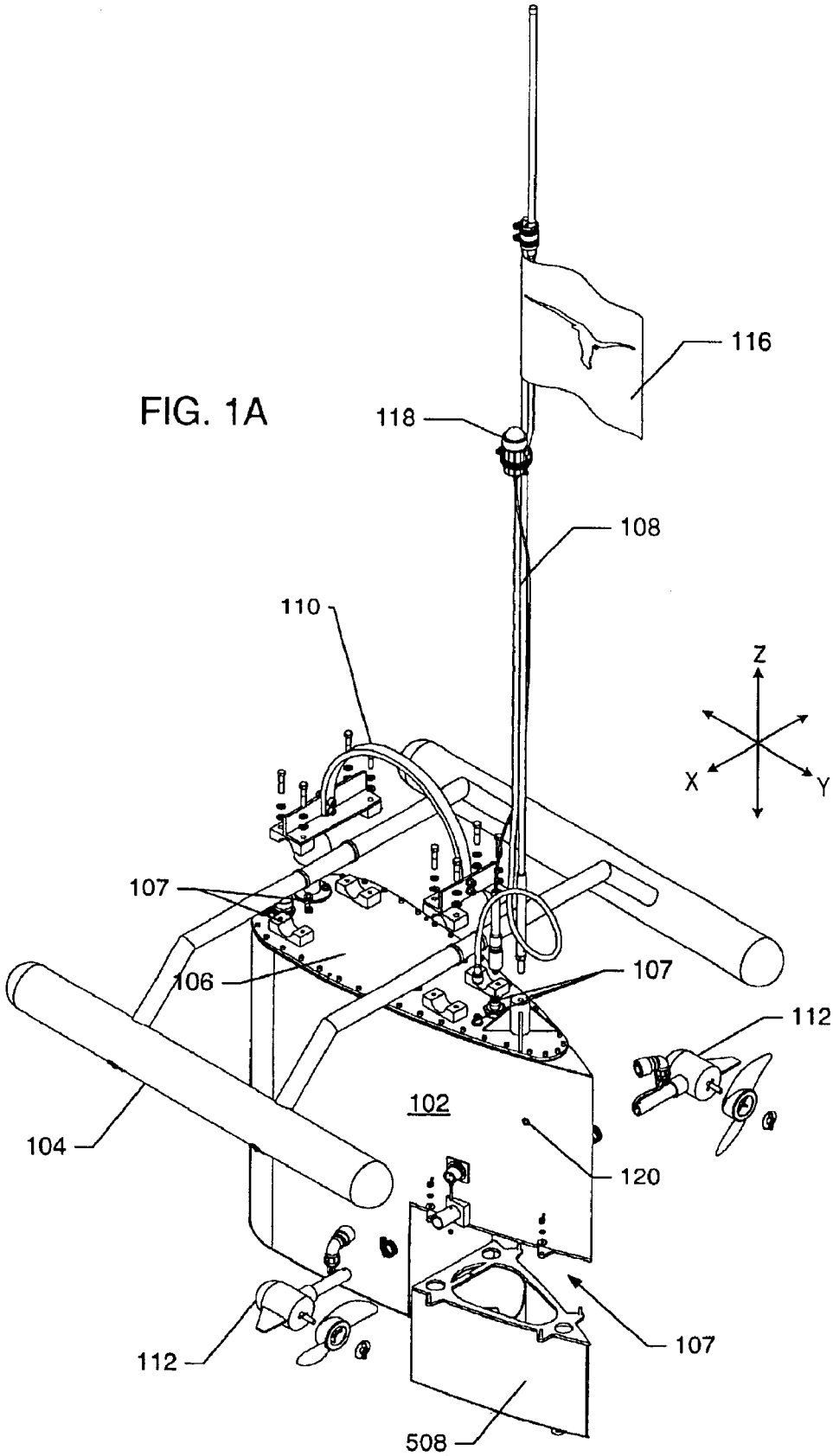
FIG. 1A depicts an exploded perspective view of a first embodiment of an autonomous surface watercraft.

While the invention is susceptible to various modifications and alternative forms, specific embodiments thereof are shown by way of example in the drawings and will herein be described in detail. It should be understood that the drawing and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Embodiments disclosed herein relate to methods and systems for remote data gathering using autonomous surface watercraft. The watercraft may independently control navigation to station points and station keeping relative to established station points. As used herein, a "station point" refers to a specific location or area to which a craft has been assigned (e.g., for data gathering, retrieval, etc.). As used herein, "station keeping" refers to maintaining a position within a relatively small area around a station point. While navigating or station keeping, a watercraft may gather sensor data. The sensor data may be combined with location data and stored in memory onboard the watercraft and/or transmitted to a control center. A control center may communicate with a plurality of watercraft to direct them to various station points within an area of interest, to receive sensor data and to process and/or store the sensor data.

As used herein, "autonomous" refers to automatically controlling various mission activities. For example, watercraft disclosed herein may automatically determine course headings, control propulsion systems, deploy and retrieve sensor devices, control power management functions, etc. As used herein, "automatically" may generally refer to an action taken without requiring manual steps on the part of an operator. Although a control center may provide minimal input, such as but not limited to station point coordinates, data gathering locations, data gathering durations, etc., control center operators generally need not steer the watercraft or manually control the watercraft systems.

Figure 1B:
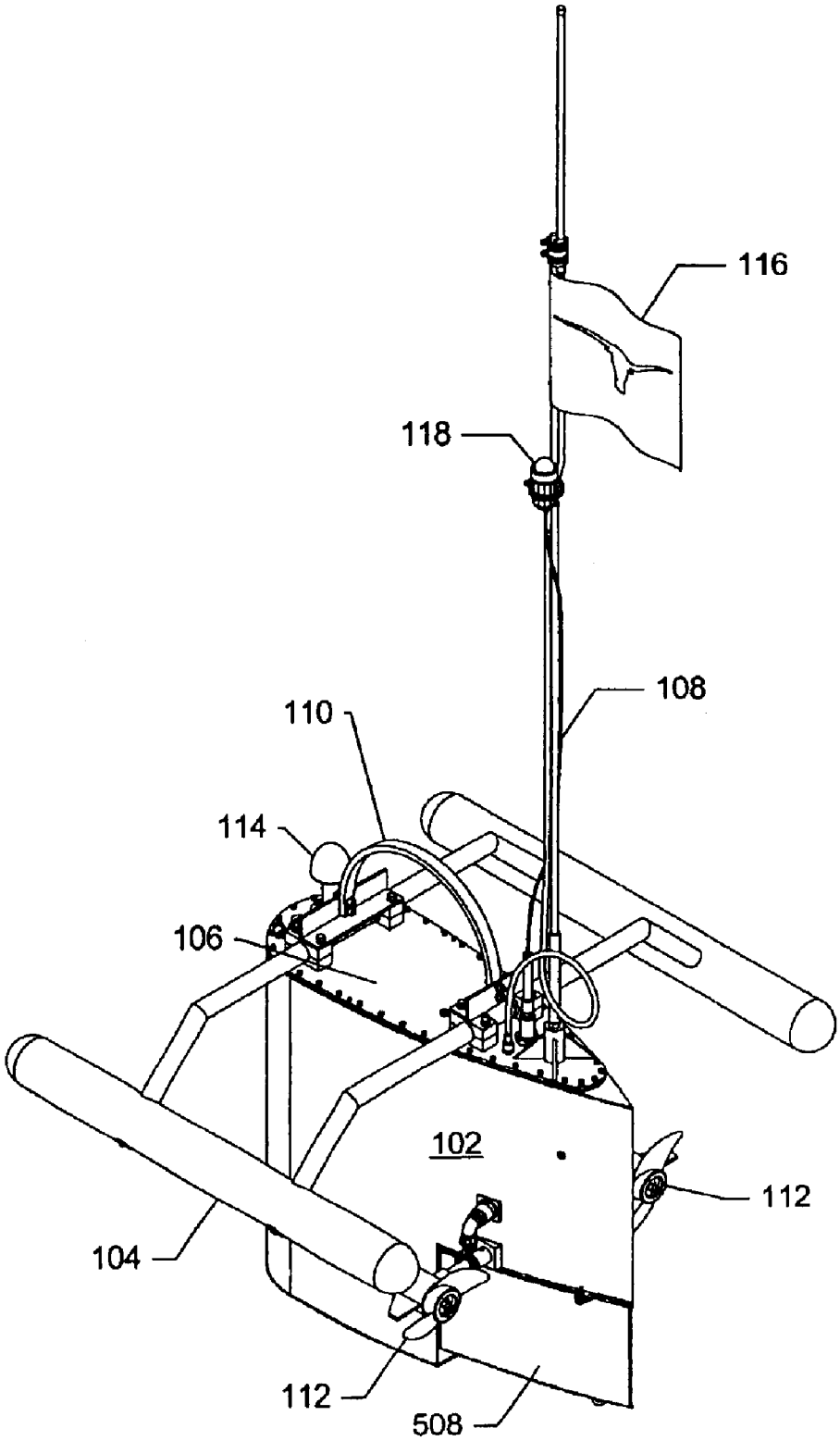
FIG. 1B depicts an assembled perspective view of the first embodiment of the autonomous surface watercraft of FIG. 1A.

In an embodiment, an autonomous surface watercraft 100 may include a hull assembly 102 as depicted in FIGS. 1A and 1B. In an embodiment, hull assembly 102 may include a plurality of hull panels coupled to an internal structural skeleton 301 (shown in FIG. 3). In such embodiments, skeleton 301 may provide mounting points for internal components. Hull assembly 102 may be configured to internally house a number of components of a data gathering system. For example, a power source (e.g., batteries 303), control module 305, communications module 307, and power management module 309 may be housed inside hull assembly 102. In certain embodiments, damping devices (e.g., spring-mass dampers) may at least partially isolate the system components from motion of hull assembly 102. Hull assembly 102 may include a substantially watertight seal to protect data gathering system components from moisture, and to preserve buoyancy. Hull assembly 102 may include a number of coupling points 107. Coupling points 107 may include electrical and/or mechanical connectors, as appropriate for a device to be coupled to the coupling point. Hull penetrations associated with coupling points 107 (e.g., electrical connections) may include a substantially watertight seal. Commercially available connectors, which may be suitable for watertight installation, are available from Burton Electrical Engineering of Gardena, Calif. Such embodiments may be configured to be deployed and recovered multiple times without the need to open the watertight seal. That is, no access may be required to the interior of hull assembly 102 for preparing the watercraft for deployment (e.g., charging the power source, setting mission parameters, attaching desired sensors, etc.) or for recovering the watercraft (e.g., recovering the watercraft from the water, downloading sensor data, checking watercraft electronic systems, checking the integrity of the watertight seal, etc.). It is believed that such a configuration may minimize the exposure of electronic components within the watercraft to potentially corrosive environments (e.g., sea air).

Figure 2:
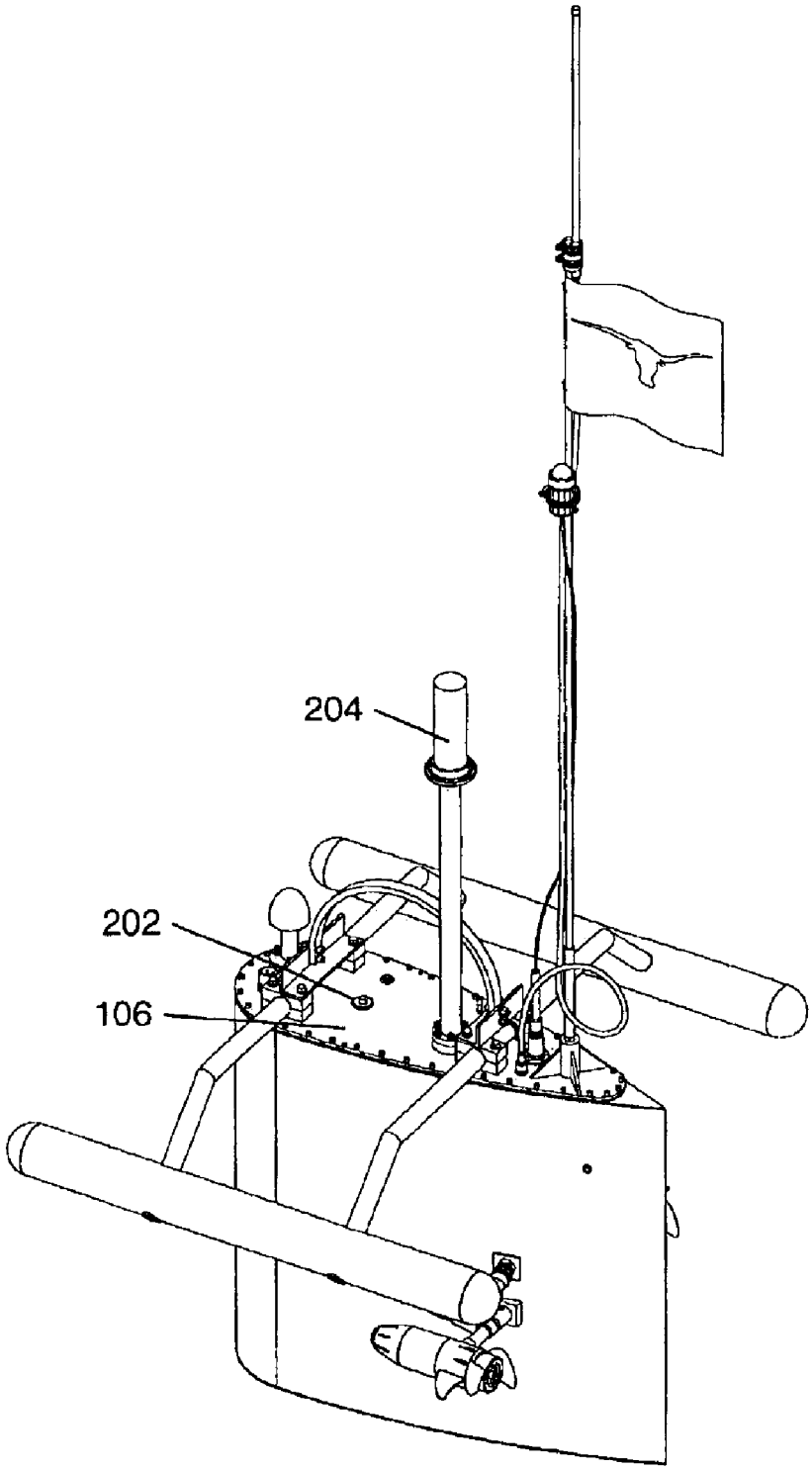
FIG. 2 depicts a perspective view of a second embodiment of an autonomous watercraft.

In certain embodiments, a water detector 202 (as shown in FIG. 2) may be provided to detect and provide an indication of the presence of water inside hull assembly 102. For example, water detector 202 may provide a visual and/or an electrical indication of water inside hull assembly 102. In an embodiment, an electrical indication may be stored in an onboard memory such that when sensor data from the memory is accessed, the indication is also accessed (e.g., a warning is provided to a user of a computer accessing the sensor data). In an embodiment, a visual indication may be provided by a water detector having a window visible through and/or projecting through a portion of hull assembly 102. For example, a window of water detector 202 may project through lid 106. An example of a water detector which provides a visual indication is the humidity detector commercially available from Halkey-Roberts of St. Petersburg, Fla. The indication of water inside hull assembly 102 may allow a user to assess the seaworthiness of the watercraft without opening the watertight seal. In an embodiment, a water collector (e.g., a desiccant) may be provided in the hull assembly. Suitable desiccants are commercially available, for example, from W.A. Hammond Drierite, Co. of Xenia, Ohio.

Referring back to FIGS. 1A and 1B, in an embodiment, hull assembly 102 may have a foil shape. In various embodiments, hull assembly 102 may have a substantially flat bottom or a rounded or otherwise contoured bottom. A substantially flat bottom may provide a relatively stable base for the watercraft during handling and/or storage of the watercraft (e.g., while onboard a ship). A rounded or otherwise contoured bottom may provide increased operational efficiency for the watercraft during operation (e.g., during navigation and/or station keeping). A foil shape may have a low drag coefficient, which may require less power for station keeping and navigation. A foil shape may also be beneficial to provide a stable platform for sensor data gathering, navigation and/or station keeping. The relatively large surface area of the foil shape when viewed along the x-axis (as shown in FIG. 1*a*) may provide the watercraft with yaw stability (i.e., resistance to rotation about the z-axis), roll stability (i.e., resistance to rotation about the y-axis) and stability along the x-axis. Additionally, the foil shape may help the watercraft to remain properly oriented with respect to a current or wind so that station keeping is efficient. In certain embodiments, additional stability may be provided by adding one or more pontoons 104 to the hull assembly. Additional stability may be desired for example, if the watercraft is to operate in a relatively unpredictable area or a body of water with a relatively rough surface. Pontoons 104 may be mounted laterally on hull assembly 102 (e.g., parallel to the foil shaped hull and at some distance from the hull along the x-axis). In an embodiment, pontoons 104 may be configured to be easily coupled to or removed from a coupling point on the watercraft. The stability of watercraft 100 may be increased by laterally mounted pontoons 104. For example, pontoons 104 may increase the pitch stability of the watercraft (i.e., resistance to rotation about the x-axis), the role stability of the watercraft, and the resistance to translation along the z-axis. In some embodiments, pontoons 104 may be configured to provide no net buoyancy to watercraft 100 except in wash-over situations. In certain embodiments, watercraft 100 may be self-righting during use. Thus, if the watercraft becomes inverted (e.g., during deployment from a ship or a wash-over situation), the watercraft buoyancy distribution may cause the watercraft to right itself in the water.

Hull assembly 102 may include a lid 106 coupled to the upper portion of the hull assembly. Lid 106 may include coupling points for various components. For example, a mast 108 may be coupled to lid 106. Mast 108 may include a communications antenna. Mast 108 may also aid in increasing the visibility of the watercraft. For example, a flag 116, light 118 or reflector may be coupled to the mast. Mast 108 and/or other elongated members extending from the watercraft may be configured to be strong and flexible to withstand high sea states. For example, mast 108 may include a fiberglass core encased in an epoxy medium within a stainless steel tube. One or more visual aids may be coupled to lid 106 (e.g., high visibility tape or paint). Lid 106 may also include other devices, such as one or more valves (e.g., for safety devices or pressure testing); one or more switches, indicators and/or electrical connections for interfacing with internal components; one or more recovery aids (e.g., lifting ring 110); a GPS antenna 114 (depicted in FIG. 1B), etc. In certain embodiments, a sensor module may be coupled to lid 106. For example, referring to FIG. 2, an antenna 204 of an RF sensor may be coupled to lid 106.

In an embodiment, hull assembly 102 may include a coupling point for a power supply charger. The power supply charger coupling point 512 (shown in FIG. 5) may allow a charging device to be electrically coupled to a rechargeable power supply 510 within hull assembly 102. Such embodiments may allow watercraft power supply 510 to be recharged without opening the substantially watertight seal of hull assembly 102. For example, in an embodiment, power supply 510 may include one or more batteries 303. Certain batteries may release hydrogen during recharging (e.g., lead acid batteries). Batteries may be selected to minimize the risk of hydrogen buildup. For example, valve regulated lead acid batteries may be less prone to release hydrogen during recharging; however, the risk of hydrogen release does not appear to be completely eliminated even with the use of valve regulated lead acid batteries. To minimize the risk of hydrogen buildup within hull assembly 102, a hydrogen collector 404 may be provided within the hull assembly. Examples of suitable hydrogen collectors are commercially available from Vacuum Energy, Inc. of Cleveland, Ohio. In certain embodiments, one or more hydrogen detectors 406 may be provided in the hull assembly. Hydrogen detector 406 may be configured to provide an indication if a potentially dangerous buildup of hydrogen within hull assembly 102 is detected. For example, hydrogen detector 406 may provide an indication of hydrogen buildup if the concentration of hydrogen within hull assembly 102 exceeds a threshold value. The threshold value may be configurable or fixed. For example, the threshold value may be set to the lower detection limit of the hydrogen detector, to the lower explosive limit of hydrogen (e.g., about 4% in air), or to some fraction of the lower explosive limit of hydrogen (e.g., ½ of the lower explosive limit). A charger configured to interface with the watercraft for recharging the power supply and/or the power management module of the watercraft may be configured to respond to the indication of hydrogen detection by stopping the battery charging process. In certain embodiments, an audible or visual alert may be provided to notify a user of the hydrogen detection. Hydrogen detectors may include metal oxide semiconductor sensors and/or catalytic combustion sensors. For example, the 652450 Transmitter commercially available from Argus Group of Roseville, Mich. may be suitable. Certain hydrogen detectors may be harmed by exposure to chemicals other than hydrogen. For example, catalytic combustion sensors may be damaged by exposure to silicone or silicone vapors. In embodiments where a catalytic combustion sensor is used, non-silicone containing products may be favorably selected for use within the hull assembly. For example, silicone free heat sink compounds, grease, etc. may be utilized.

In an embodiment, passive scuttling methods may be employed to inhibit watercraft 100 from becoming a navigational hazard in the event that communications are lost between a control center and watercraft 100 and the watercraft cannot be recovered. For example, one or more water-soluble plugs may be placed in a scuttling port 120 (shown in FIG. 1A) of watercraft 100. The water-soluble plugs may be selected to dissolve through over a period of exposure to water. Thus, if the watercraft is deployed and not retrieved before the soluble plugs dissolve, the plugs may dissolve sufficiently to allow water into hull assembly 102 through scuttling port 120. In certain embodiments, watercraft 100 may also be configured to implement a scuttling process based on a command signal received from the control center. For example, scuttling port 120 may include a valve that may be opened by the control module upon receipt of a scuttling command.

Watercraft 100 may include a propulsion system. In an embodiment, the propulsion system may include a plurality of thrusters 112 configured to provide differential thrust. In such embodiments, the propulsion system may provide both propulsion and directional control. For example, by controlling thrust from each of two laterally mounted thrusters 112, both direction and speed of the watercraft may be controlled. In an embodiment, thrusters may include modified trolling motors. For example, the shaft of a trolling motor may be cut and sealed. The shaft may be modified as needed to allow the motor to be coupled to the hull assembly at a coupling point. Electrical connections to the motor may be modified to provide strain relief for the connection and a suitable electrical connector to electrically couple the motor to the watercraft.

Figure 3:
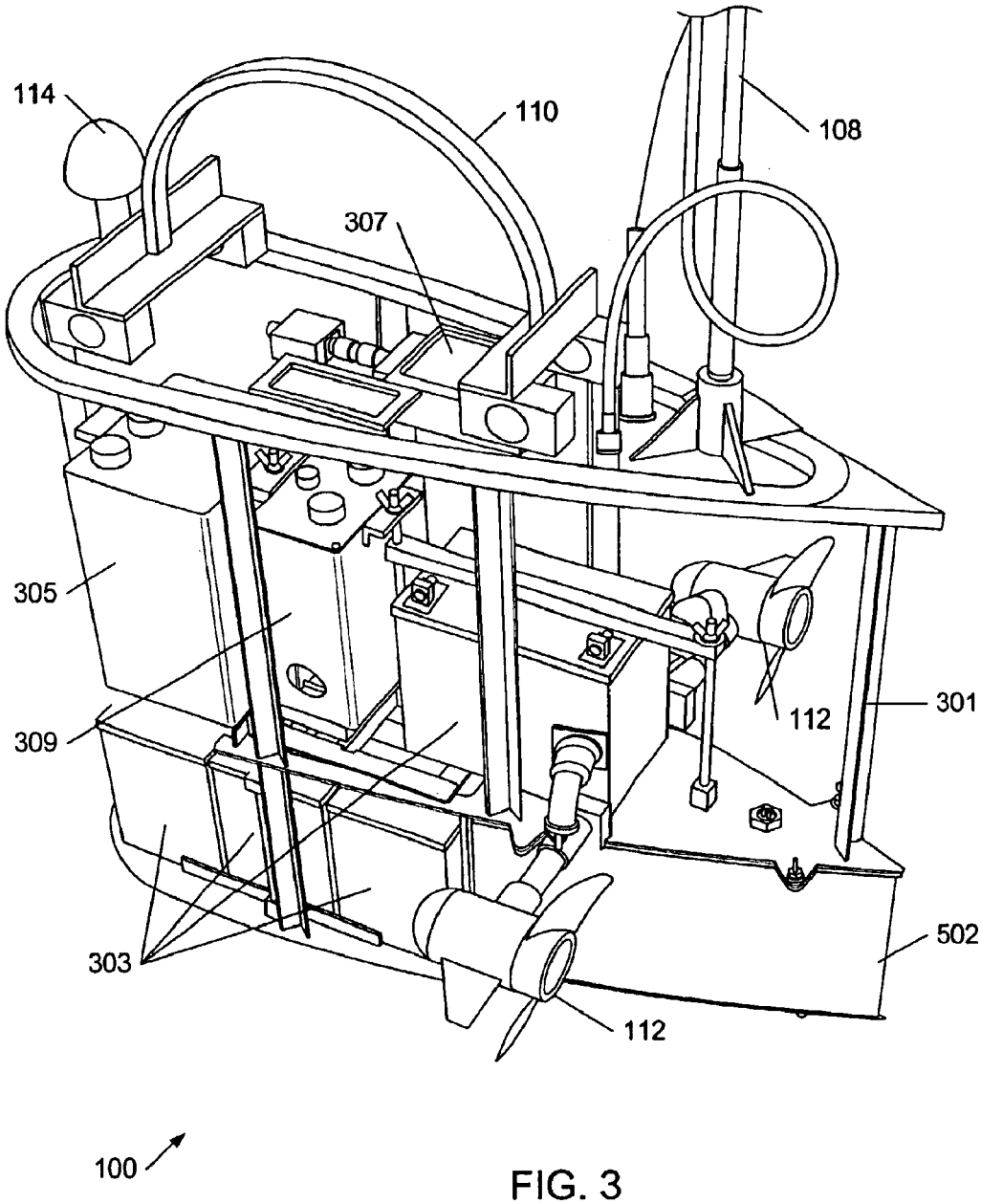
FIG. 3 depicts a perspective view of the autonomous surface watercraft of FIG. 1A with the skin of the hull assembly removed.
Figure 5:
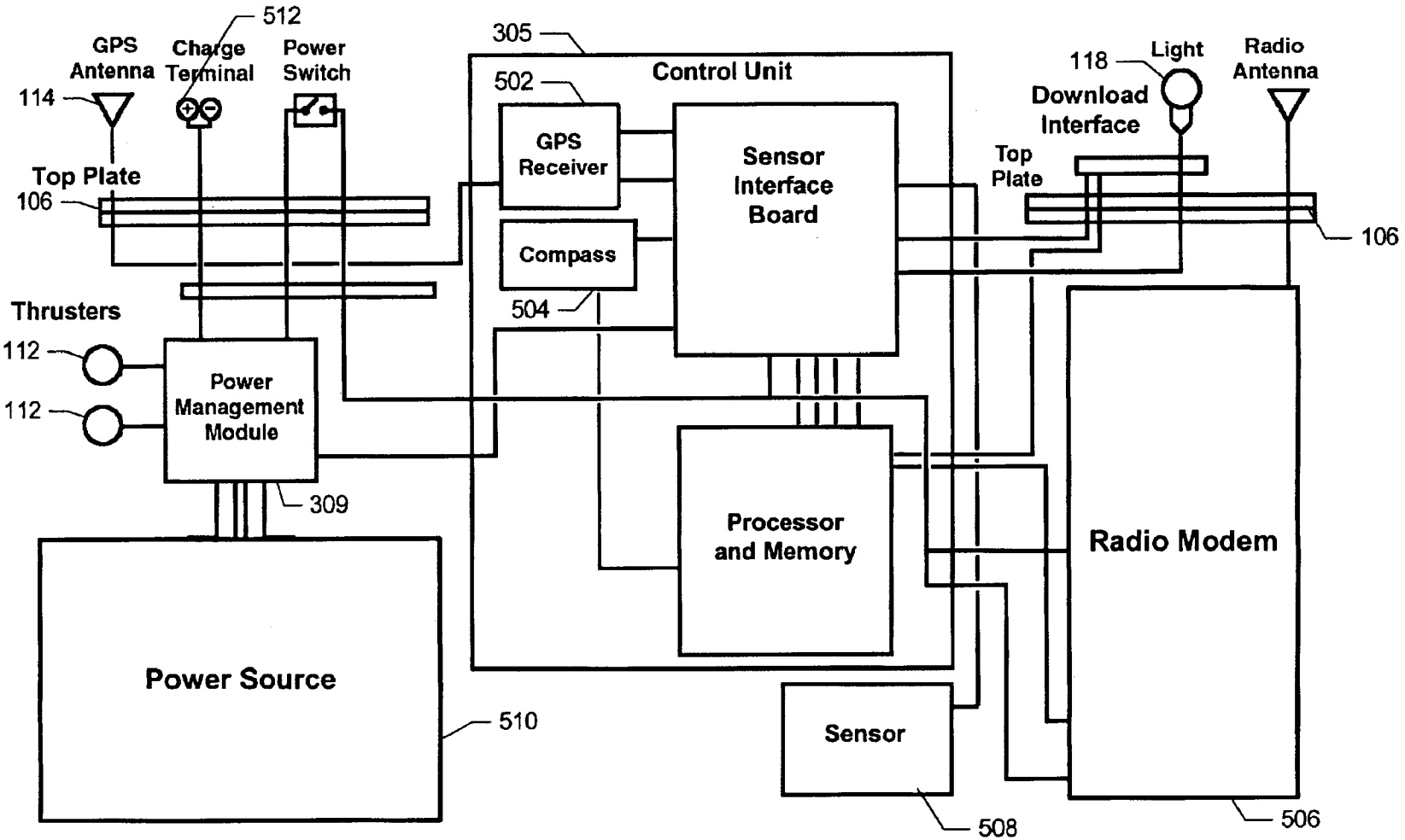
FIG. 5 depicts a schematic view showing the relationships between various watercraft components according to one embodiment.

In an embodiment, during navigation and station keeping, control signals may be sent to the propulsion system from a control module 305 (depicted in FIGS. 3 and 5). Control module 305 may determine the control signals based at least in part on location information received from a navigation module. The navigation module may use a Global Positioning System (GPS) receiver 502 to receive GPS signals. The GPS signal data may be used by control module 305 to determine the location of the watercraft. In some embodiments, the navigation module may also include a compass 504 to assist in orientation and course setting determinations. Control module 305 may determine a course heading from a present location to a station point based on location data and an estimate of speed and direction of a current and/or speed and direction of the wind. For example, an estimate of current and/or wind speed and direction may be determined from changes in the position of watercraft 100 during periods of drifting.

Figure 6:
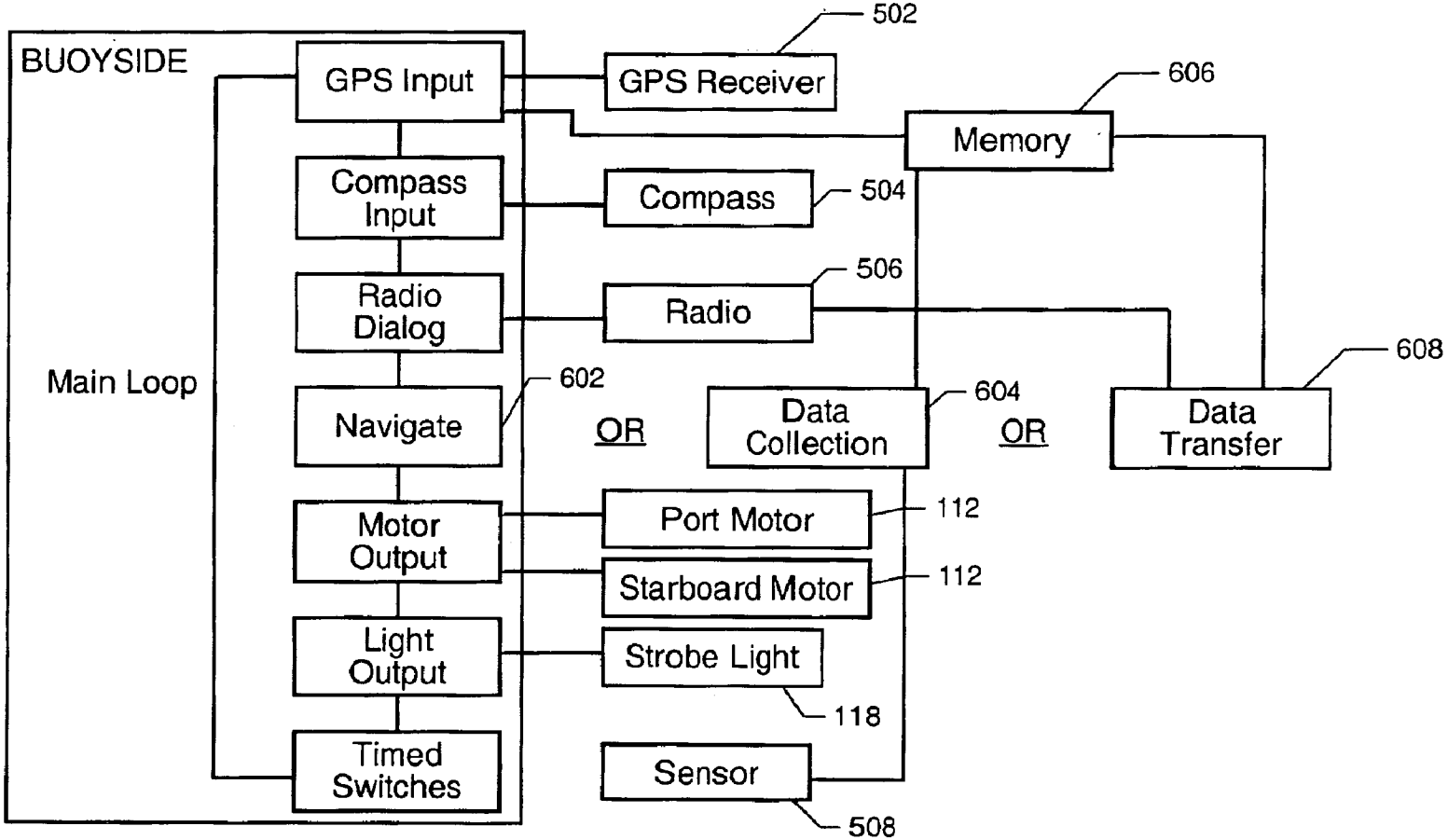
FIG. 6 depicts an embodiment of a control system architecture for an autonomous watercraft.
Figure 7:
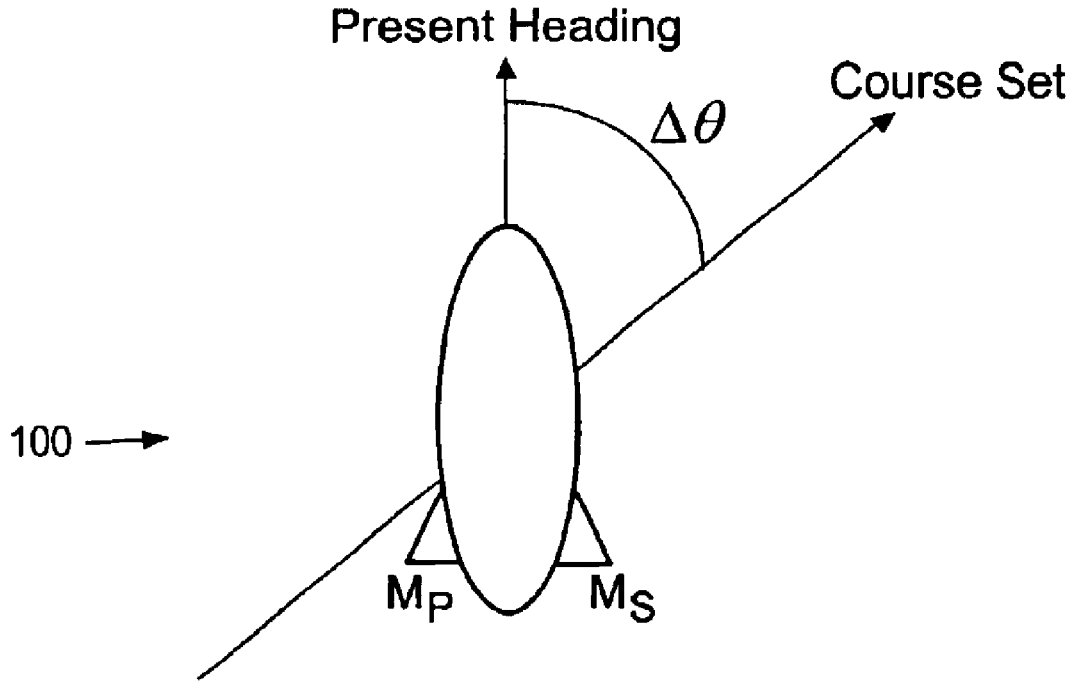
FIG. 7 depicts the angle θ between a heading and a course set.

Control module 305 may control other functions of the watercraft as well. In an embodiment, control module 305 may perform functions such as but not limited to processing sensor data, associating sensor data with location and/or time stamps, sending propulsion control signals to the propulsion system (or power management module), performing system diagnostics, and communicating with a control center. An exemplary embodiment of a control architecture for control module 305 is depicted in FIG. 6. In FIG. 6, control module 305 may receive input data from GPS receiver 502, compass 504 and a communications module 307 (e.g., radio modem 506). The control module may use the input data to navigate the watercraft (step 602). The navigation may include determining a course setting for station keeping or a course setting to reach a station point. In either case, a course setting may be determined such that the angle θ, between the heading of the watercraft and the course set, (depicted in FIG. 7) is minimized. Power usage may be optimized if the course set is opposite to net external forces on the watercraft due to wind and current while station keeping, or directed toward a station point. Additionally, in station keeping mode, control module 305 may control the propulsion system to accurately counter current motions while ignoring short-term GPS errors.

In an embodiment, control module 305 may provide propulsion control signals to a power management module (PMM) 309. In an alternate embodiment, control module 305 may provide propulsion control signals directly to the propulsion system. In embodiments where control signals are sent to a PMM first, the PMM may process the control signals to optimize power usage. The propulsion system (e.g., thrusters 112) may be operated as directed by the propulsion control signals. In some embodiments, control module 305 may also provide control signals to one or more ancillary devices, such as a light output to a strobe light 118. In some embodiments, control module 305 may also implement diagnostics of various system components (e.g., radio 506, batteries 303, etc.).

In addition to navigating watercraft 100, control module 305 may gather and/or process sensor data, as depicted at step 604. At step 604, data may be received from a sensor module 508 by control module 305. Control module 305 may store the sensor data in a memory 606 onboard the watercraft. In addition to storing the sensor data in memory, control module 305 may associate a time stamp and/or a location stamp with the sensor data. The sensor data may be retained onboard the watercraft (e.g., in onboard memory 606). In certain embodiments, a data processor module separate from control module 305 may process and/or store sensor data. In some embodiments, the sensor data may be transferred to a control center at step 608. Transferring sensor data may reduce the amount of memory needed for data collection on the watercraft. Additionally, transferring the sensor data may allow a computer system at the control center to process the data and/or correlate sensor data received from a plurality of simultaneously operating watercraft. In certain embodiments, sensor data may be transferred locally (e.g., downloaded via a physical connection to the watercraft after the watercraft is recovered). In certain embodiments, sensor data may be transferred remotely (e.g., transmitted via a wireless connection).

To transfer the sensor data to the control center, control module 305 may use a communications module 307 (depicted in FIG. 3). In an embodiment, communications module 307 may include a radio modem transceiver 506 to transmit data including but not limited to system diagnostics, location, sensor data, and command confirmations to the control center. Additionally, communications module 307 may receive data from the control center. For example, communications module 307 may receive station point coordinates, sensor control commands, status inquiries and/or other command signals from the control center.

Figure 8:
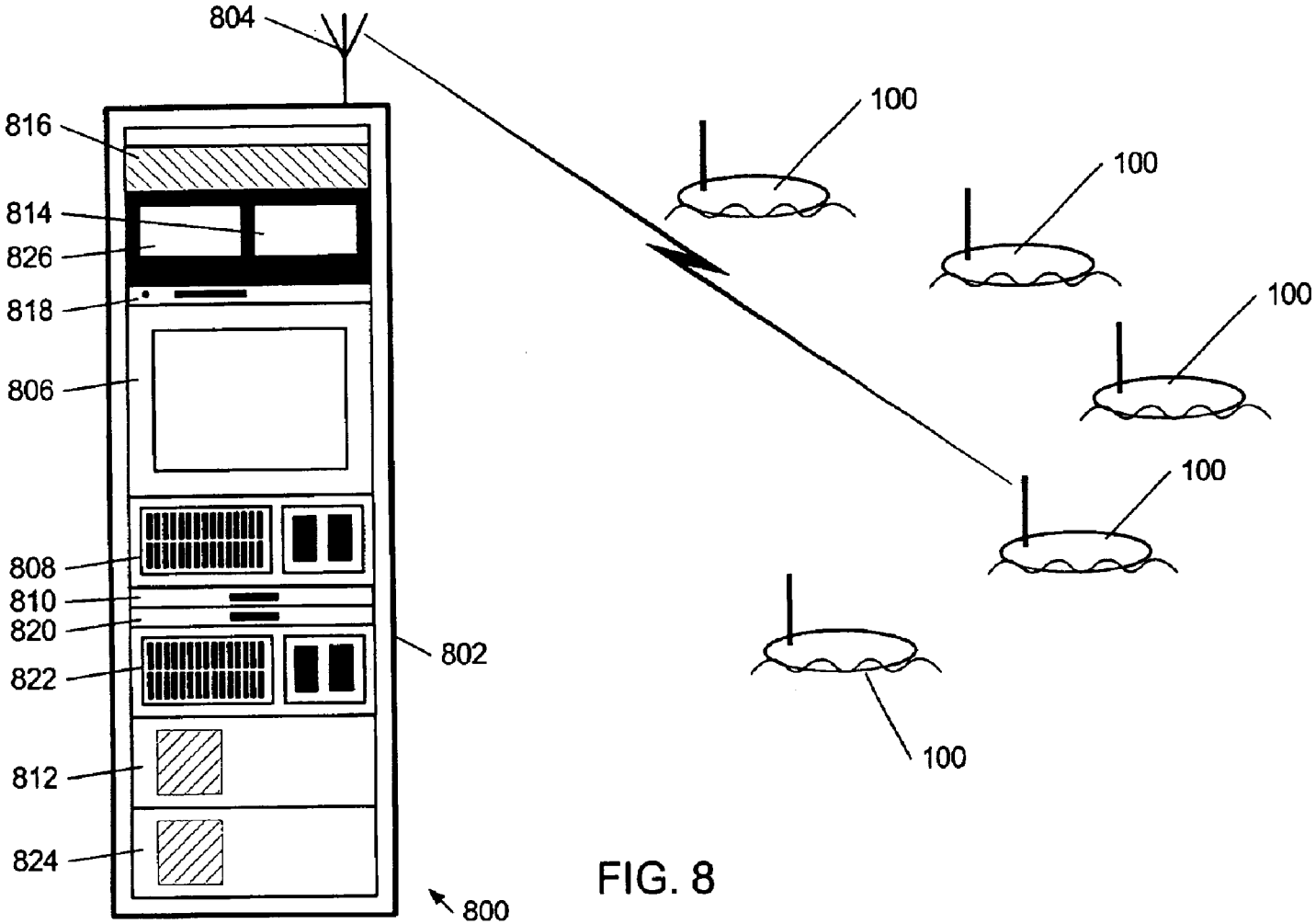
FIG. 8 depicts a schematic view of a control center in relation to a plurality of autonomous watercraft.

Control center 800 depicted in FIG. 8, may communicate with a plurality of watercraft 100. In an embodiment, control center 800 may include a computer system 802 and a communications system 804. In an embodiment, computer system 802 may include a display device 806, a central processing unit 808, and a user input device 810 (e.g., a keyboard and/or cursor positioning device). In addition, computer system 802 may include at least one uninterrupted power supply 812. In an embodiment, computer system 802 may include at least one GPS receiver 814 and a GPS power supply 816. For example, a survey-grade GPS receiver may be provided to enable determination and display of relative position of one or more watercraft 100 and control center 800. Suitable GPS receivers may include Ashtech brand GPS receivers available from Thales Navigation of Santa Clara, Calif. Computer system 802 may also include a communications panel 818. Communications panel 818 may be configured to transmit and receive voice communication between an operator of control center 800 and one or more individuals assisting in launching and/or retrieving watercraft 100. As depicted in FIG. 8, computer system 802 may include both primary and secondary devices for some functions. For example, user input device 810 may be a primary user input device; whereas user input device 820 may be a secondary user input device. Other secondary devices may include, but are not limited to secondary central processing unit 822, secondary uninterrupted power supply 824 and/or secondary GPS receiver 826. Secondary devices may act as backup devices in case of failure of a primary device. In an embodiment, control center 800 may be onboard a ship or other vessel. In an alternate embodiment, control center 800 may be located in a land-based installation. Control center 800 may be located near enough to watercraft 100 to allow direct communication. Alternately, a communications relay device (e.g., a satellite, or radio buoy) may be used to increase the distance between control center 800 and watercraft 100. In an embodiment, control center 800 may track location and sensor data for each watercraft 100 in real-time. As used herein, "real-time" may generally refer to a response to stimuli within some relatively small upper limit of response time (e.g., seconds or minutes). Tracking location and sensor data in real-time may allow control center 800 to provide a graphical representation depicting relevant sensor data (e.g., a map) to an operator. It is believed that such simultaneous, real-time data processing and analysis may allow the operator to quickly identify relevant information (e.g., locations of interest, missing data, etc.). Additionally, having real-time access to sensor data may allow the operator to make timely modification to mission parameters (e.g., time, duration and location of data collection).

Figure 4:
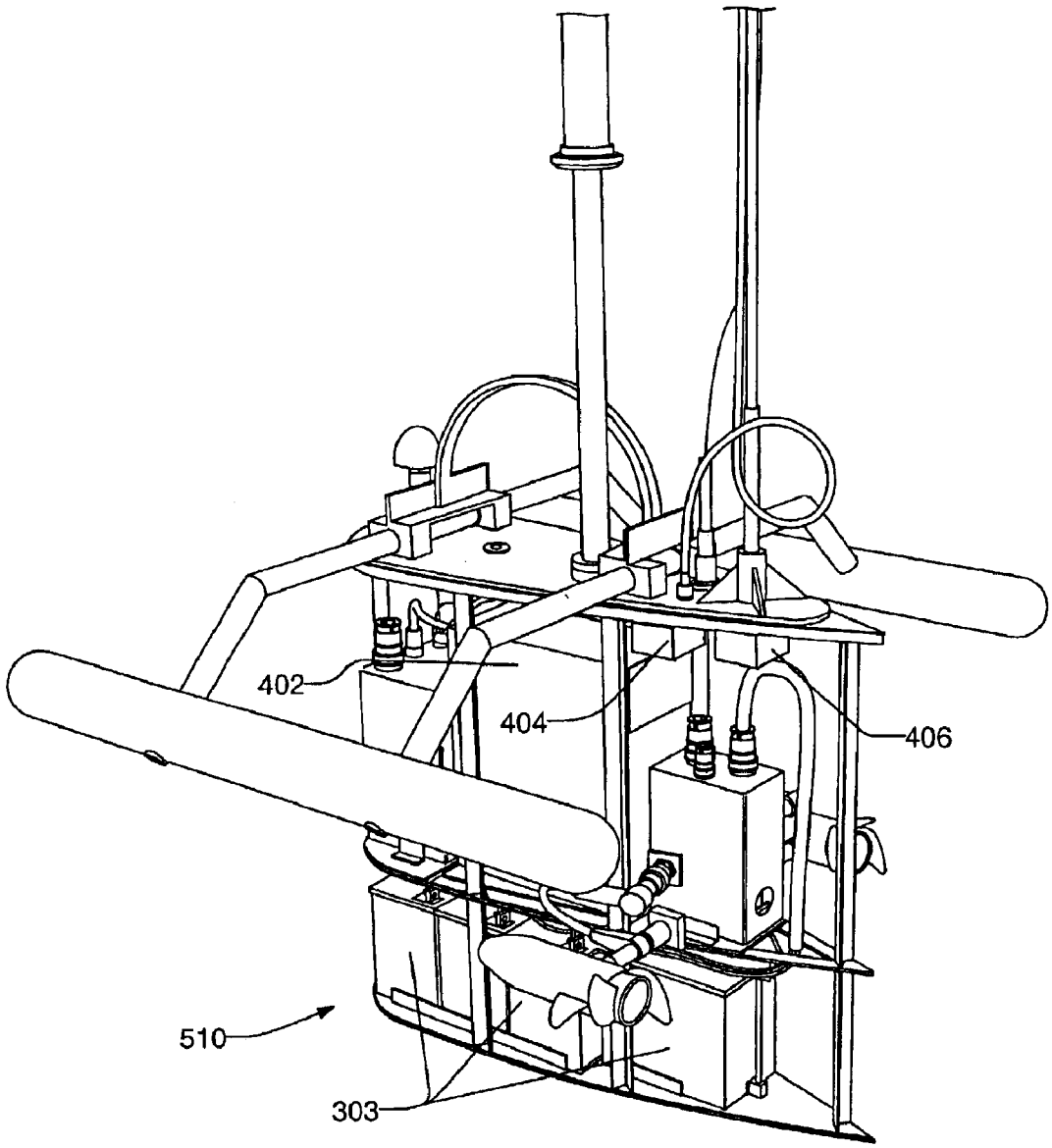
FIG. 4 depicts a perspective view of the autonomous surface watercraft of FIG. 2 with the skin of the hull assembly removed.
Figure 9:
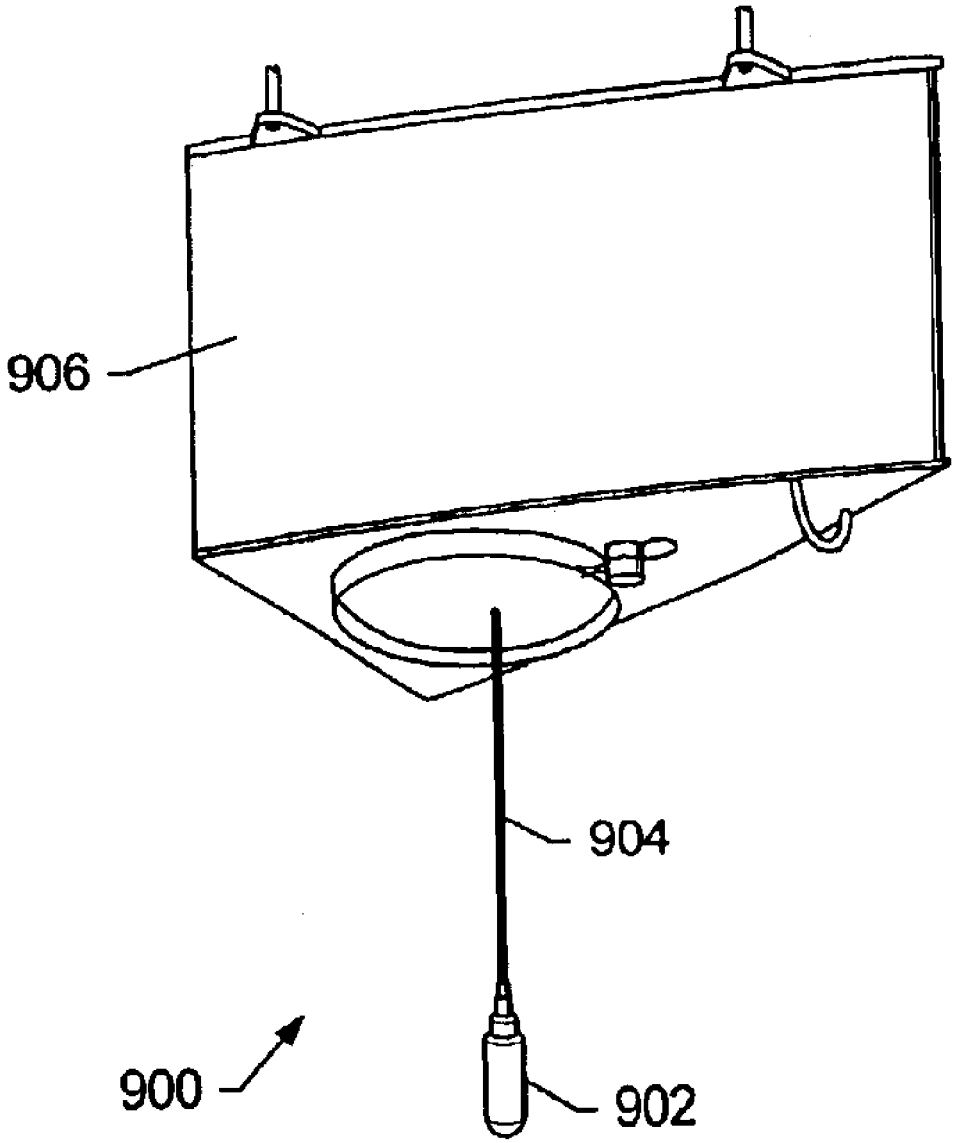
FIG. 9 depicts a perspective bottom view of a sensor module.

In an embodiment, watercraft 100 may include a coupling point 107 for attaching one or more sensor modules 508. Coupling point 107 may be configured to allow one or more sensor modules 508 to be mechanically and electrically coupled to watercraft 100. In such an embodiment, a number of interchangeable sensor modules 508 may be provided. For example, a hydrophone sensor module 900 (depicted in FIG. 9) may be provided. Hydrophone sensor module 900 may include a deployable hydrophone 902. Hydrophone 902 may be deployed on an elongated member 904 extending from the sensor module. Elongated member 904 may allow hydrophone 902 to be deployed to a desired sensing depth for data gathering. After data gathering, hydrophone 902 may be retracted into a sensor module housing 906 for safety and/or transportation. Elongated member 904 may be coupled to sensor module housing 906 by a damping mechanism, such as a spring-mass damper. In certain embodiments, one or more sensors may be completely or partially enclosed within the hull assembly. For example, a radio frequency (RF) sensor (as depicted in FIG. 4) may include a portion disposed within the hull assembly (e.g., a receiver 402) and a portion disposed outside the hull assembly (e.g., an antenna 204). Sensor modules 508 may include, but are not limited to: water analysis sensors (e.g., chemical sensors, water temperature sensors, etc.), environmental sensors (e.g., atmospheric temperature sensors), active sonar sensors, magnetic sensors, electromagnetic sensors (e.g., RF sensors, optical sensors, etc.). Sensors may be deployed and/or turned on automatically upon deployment of the watercraft, at a predetermined time, at a predetermined location and/or upon receipt of a sensor control command from control center 800. In an embodiment, one or more sensor modules may be controlled by control module 305. In such embodiments, control module 305 may determine when to deploy a sensor, when to initiate data gathering, when to cease data gathering, when to retrieve a sensor, etc. For example, control module 305 may control one or more sensor modules based on one or more mission parameters (e.g., station point, etc.).

In an embodiment, sensor data may be analyzed and/or filtered by an onboard data processor before storage or transmittal. In some such embodiments, data processing and/or filtering circuitry may be provided in control module 305. Data processing and/or filtering parameters may also be controlled by commands from control center 800. Thus, control center 800 may be able to change data analysis and/or filtering parameters (e.g., sampling time, etc.) remotely. It is believed that remotely controlling data analysis and/or filtering may allow the operator to use available data transmission bandwidth efficiently.

In an embodiment, power for navigation, communication, sensing, etc. may be provided by an onboard power source. For example, the power source may include, but is not limited to a fuel cell or one or more batteries 303. In such an embodiment, a power management module (PMM) 309 (depicted in FIG. 3) may control power conditioning, battery charging, providing power to watercraft components, etc. PMM 309 may include but is not limited to motor power control circuitry, fuses, cooling fans, battery charging circuitry and battery failure protection circuitry, etc. Motor control circuitry may provide power to one or more propulsion system motors as directed by propulsion control signals from control unit 305. In an embodiment, PMM 309 may incorporate pulse width modulation into propulsion system control signals to gain efficiency in the use of propulsion system motors. Fuses may provide over current protection for system components (e.g., in the event of a short circuit). Battery failure protection circuitry may regulate power distribution such that failure of one or more batteries 303 reduces operating duration of the watercraft rather than affecting the performance of watercraft components. It is envisioned that in some embodiments, system power may be derived from or supplemented by other power sources. For example, in some embodiments, solar power may be used to provide a trickle charge to one or more batteries 303 to increase the operating duration of the system. In certain embodiments, PMM 309 may be configured to receive a hydrogen detection indication from a hydrogen detector. In such embodiments, PMM 309 may inhibit charging of batteries 303 in response to the hydrogen detection indication so that charging does not release additional hydrogen into hull assembly 102.

In one embodiment of a method of gathering data using at least one autonomous watercraft, at least one autonomous watercraft may be deployed to navigate within an area of interest. After being deployed, the watercraft may navigate to an assigned station point. While navigating or upon reaching the station point, the watercraft may gather sensor data. It is envisioned that such a method of gathering data may be useful for gathering "scanning" data (i.e., data gathered for the area over a period of time) over a relatively large area with minimal cost and/or time required. Sensor modules deployed with the watercraft may be alike (e.g., all sensor modules may be hydrophones) or of different types.

In an alternate embodiment, at least one watercraft may be deployed at its station point. In such an embodiment, the watercraft may act as a station-keeping buoy. An array of such buoys may be deployed to gather a "snap shot" of data (i.e., simultaneously gathering data over the entire area of interest).

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description to the invention. Changes may be made in the elements described herein without departing from the spirit and scope of the invention as described in the following claims. In addition, it is to be understood that features described herein independently may, in certain embodiments, be combined.

What is claimed is:

1. An autonomous watercraft comprising: a vertical hull assembly comprising at least one sensor module coupling point, wherein the vertical hull assembly comprises a fore end, an aft end, a top, a bottom, an interior region, a longitudinal axis extending between the fore end and the aft end, wherein the vertical hull assembly has a generally tear drop shaped cross sectional profile extending along the longitudinal axis, and wherein at least one sensor module coupling point is configured to allow a sensor module to be coupled to the vertical hull assembly without opening a watertight seal of the vertical hull assembly; at least one control module coupled to the vertical hull assembly; and at least one propulsion device coupled to the vertical hull assembly, wherein at least one propulsion device is in operative communication with at least one control module.

2. The watercraft of claim 1, further comprising at least one navigation module disposed within the vertical hull assembly, wherein at least one navigation module is configured to provide a navigation signal to at least one control module.

3. The watercraft of claim 1, further comprising at least one navigation module disposed within the vertical hull assembly, wherein at least one navigation module comprises a global positioning receiver.

4. The watercraft of claim 1, further comprising at least one navigation module disposed within the vertical hull assembly, wherein at least one navigation module comprises at least one compass.

5. The watercraft of claim 1, wherein the control module is configured to estimate a speed and direction of a current.

6. The watercraft of claim 1, further comprising at least one battery.

7. The autonomous watercraft of claim 6, wherein at least one battery comprises a lead acid battery.

8. The watercraft of claim 6, wherein at least one battery comprises a valve regulated lead acid battery.

9. The watercraft of claim 6, further comprising at least one hydrogen sensor, wherein at least one hydrogen sensor is configured to send a signal indicating detection of hydrogen during charging of at least one battery.

10. The watercraft of claim 6, further comprising at least one battery charger coupled to the vertical hull assembly.

11. The watercraft of claim 6, further comprising at least one battery charger and at least one hydrogen detector, wherein at least one battery charger is configured to inhibit charging of at least one battery if at least one hydrogen detector detects more than a threshold concentration of hydrogen.

12. The watercraft of claim 6, further comprising at least one battery charger and at least one hydrogen collector, wherein at least one hydrogen collector is configured to inhibit concentration of hydrogen within the vertical hull assembly during battery charging from exceeding a threshold concentration.

13. The watercraft of claim 6, wherein at least one battery is configured to be recharged without opening the substantially water-tight seal of the vertical hull assembly.

14. The watercraft of claim 6, further comprising at least one battery charger coupled to the vertical hull assembly, wherein at least one battery charger is configured to charge at least one battery while the autonomous watercraft is deployed.

15. The watercraft of claim 6, further comprising at least one solar battery charger.

16. The watercraft of claim 1, further comprising at least one water detector device coupled to the vertical hull assembly, wherein at least one water detector is configured to provide an indication of the presence of water inside the vertical hull assembly.

17. The watercraft of claim 1, further comprising a power management module.

18. The watercraft of claim 1, further comprising at least one scuttle port, wherein at least one scuttle port is configured to allow water into the vertical hull assembly if the watercraft is in water for longer than a predetermined period.

19. The watercraft of claim 1, further comprising at least one scuttle port, wherein at least one scuttle port is configured to allow water into the vertical hull assembly upon receipt of a command.

20. The watercraft of claim 1, further comprising at least one communications module, wherein at least one communications module is configured to receive commands from a remote command station.

21. The watercraft of claim 1, further comprising at least one communications module, wherein at least one communications module is configured to send data to a remote command station.

22. The watercraft of claim 1, wherein the watercraft is configured to be self-righting during use.

23. The watercraft of claim 1, wherein at least one propulsion device comprises two or more thrusters coupled to the vertical hull assembly, wherein two or more thrusters are configured to provide variable thrust.

24. The watercraft of claim 1, wherein at least one propulsion device comprises two or more thrusters coupled to the vertical hull assembly, wherein two or more thrusters are configured to steer the watercraft by providing differential thrust during use.

25. The watercraft of claim 1, wherein at least one control module is configured to interact with at least one sensor module coupled to at least one sensor module coupling point to control data gathering by at least one sensor module.

26. The watercraft of claim 1, further comprising a roll stabilizing apparatus coupled to the vertical hull assembly.

27. The watercraft of claim 1, further comprising a recovery aid coupled to the vertical hull assembly.

28. The watercraft of claim 1, further comprising a lifting ring coupled to the vertical hull assembly.

29. The watercraft of claim 1, further comprising at least one sensor module coupled to at least one sensor module coupling point.

30. The watercraft of claim 1, further comprising at least one sensor module coupled to at least one sensor module coupling point, wherein at least one sensor module comprises a hydrophone.

31. The watercraft of claim 1, further comprising at least one sensor module coupled to at least one sensor module coupling point, wherein at least one sensor module comprises a sonar module.

32. The watercraft of claim 1, further comprising at least one sensor module coupled to at least one sensor module coupling point, wherein at least one sensor module comprises a water analysis module.

33. The watercraft of claim 1, further comprising at least one sensor module coupled to at least one sensor module coupling point, wherein at least one sensor module comprises a radio frequency detector.

34. The watercraft of claim 1, further comprising at least one sensor module coupled to at least one sensor module coupling point, wherein at least one sensor module comprises a retractable portion.

35. The watercraft of claim 1, further comprising at least one sensor module coupled to at least one sensor module coupling point, wherein at least one sensor module is configured to deploy a sensor portion to a desired depth at a station point for data gathering and to retract the sensor portion after data gathering is complete.

36. The watercraft of claim 1, further comprising at least one memory, wherein at least one memory is configured to receive and store data gathered by at least one sensor module coupled to at least one sensor module coupling point.

37. The watercraft of claim 1, further comprising at least one data processor, wherein at least one data processor is configured to process data gathered by at least one sensor module coupled to at least one sensor module coupling point.

38. The watercraft of claim 1, wherein the vertical hull assembly comprises a foil shaped cross-section.

39. An autonomous surface watercraft comprising: a vertical hull assembly, wherein the vertical hull assembly comprises a generally tear drop shaped cross sectional profile extending in the direction of travel and an interior region; at least one rechargeable power source disposed within the vertical hull assembly; at least one propulsion device coupled to the vertical hull assembly and operatively coupled to at least one rechargeable power source; and at least one connection point on the vertical hull assembly, wherein at least one connection point allows at least one rechargeable power source to be recharged without opening the substantially water-tight seal.

* * * * *